United States Patent [19]

Symon

[11] Patent Number: 4,488,378

[45] Date of Patent: Dec. 18, 1984

[54] BUILDING ENTRANCE

[75] Inventor: Ernest B. Symon, South Bend, Ind.

[73] Assignee: Kawneer Company, Inc., Atlanta, Ga.

[21] Appl. No.: 470,188

[22] Filed: Feb. 28, 1983

[51] Int. Cl.[3] ..... E05C 15/02; E05B 65/10

[52] U.S. Cl. ..... 49/141; 49/366; 49/395; 292/21; 292/92

[58] Field of Search ..... 49/141, 366, 395, 319; 292/21, 92

[56] References Cited

U.S. PATENT DOCUMENTS

| | | | |
|---|---|---|---|
| 1,203,965 | 11/1916 | Bogenberger | 292/21 |
| 2,887,336 | 5/1959 | Meyer | 292/21 |
| 2,910,857 | 11/1959 | Muessel | 292/21 X |
| 3,087,323 | 4/1963 | Foster | 292/92 X |
| 3,819,213 | 6/1974 | Vanderburgh | 292/21 |
| 3,888,046 | 6/1975 | Meisterheim | 49/366 X |
| 4,083,590 | 4/1978 | Folger | 292/21 X |
| 4,204,369 | 5/1980 | Hubbard | 49/366 X |
| 4,225,163 | 9/1980 | Hubbard et al. | 292/21 |
| 4,283,882 | 8/1981 | Hubbard et al. | 49/141 |

*Primary Examiner*—Philip C. Kannan

*Attorney, Agent, or Firm*—Jones & Askew

[57] ABSTRACT

An entrance for buildings comprises first and second doors mounted in a common door frame, each door including a lock stile positioned adjacent a lock stile of the other door when the doors are closed. A panic device is mounted on at least one of the doors for emergency opening thereof and a retractable latch is extended between the stiles of the doors when closed for minimizing or eliminating the unauthorized forced separation of the stiles into a position wherein the panic device can be actuated with an implement inserted from outside the entrance to release and open the door. Mechanism is included for interconnecting the latch and the panic device for retraction of the latch when the panic device is actuated for opening the door, thus providing both a safe and a secure entrance system.

13 Claims, 12 Drawing Figures

Fig. 1
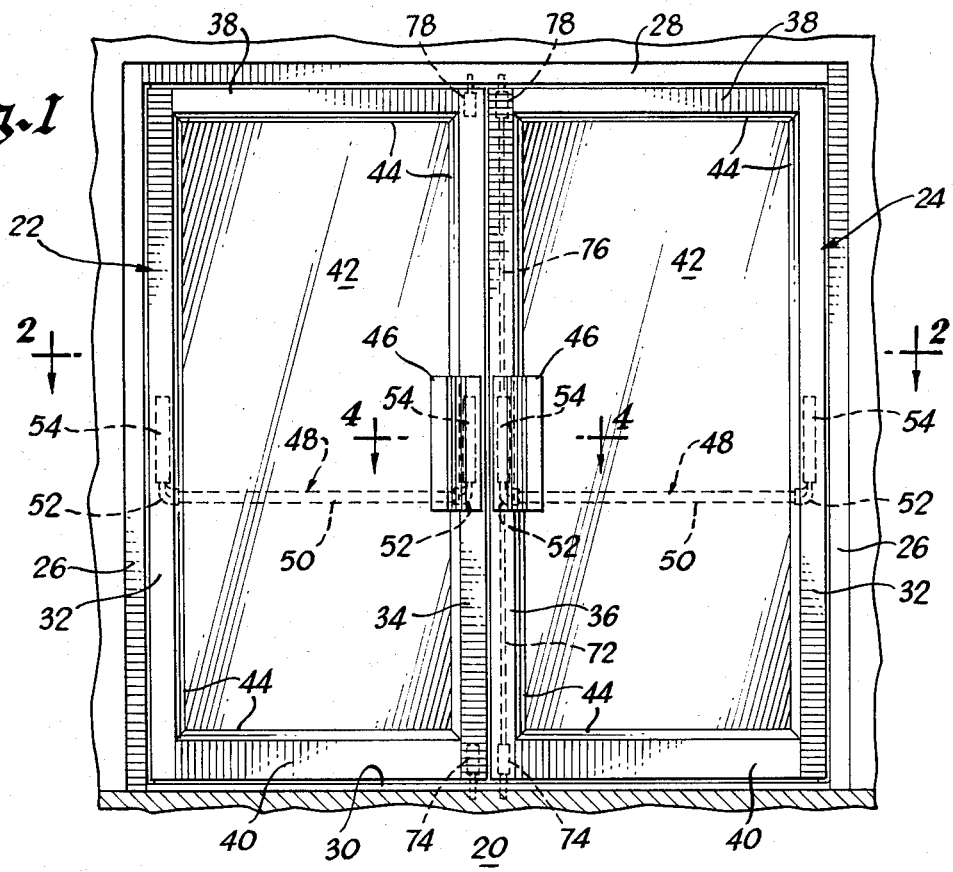
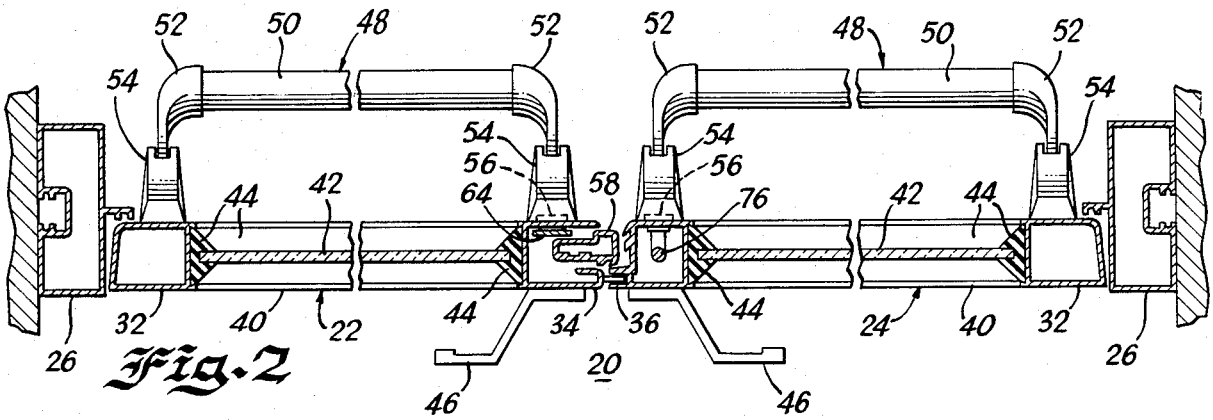
Fig. 2
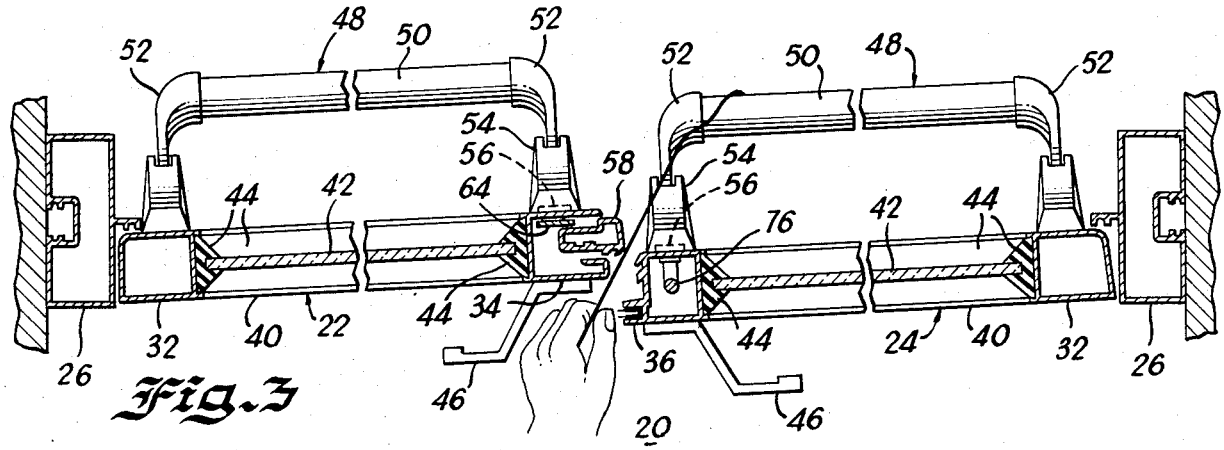
Fig. 3

34
36a
36
44
42
46A
76
98
99
95
97
102
76a
100
36b
96
58
71
70
70b
72a
80
96a
94
58A
59
84b
72
70a
99
88
105
90
84
70c
39
49
44
86
88a
84a
88c
88b
73
82
92
42
22A
24A
70
81
80
70a
84b
84
88c
88
88a
84a
70c
73
86
92
82
88b
88d

BUILDING ENTRANCE

BACKGROUND OF THE INVENTION

Field of the Invention

The present invention relates to entrances for buildings and more particularly, entrances used in commercial and industrial buildings wherein it is desirable to provide a secure entrance system, yet at the same time, provide an emergency exit for evacuation of persons from the building even though the entrance has been closed and locked for the night or weekend.

Many building codes require that the entrances of commercial and industrial buildings or public buildings generally be provided with panic devices for allowing emergency exit from the building even though the doors have been locked, closed and secured for the night or weekend.

A common type of panic actuating device includes a U-bar pivotally mounted on the inside face of a door with a cross-memeber which may be pressed inwardly toward the door face release and unlatch the door to pivot outwardly to afford an emergency exit for persons within the building. U.S. Pat. No. 2,910,857 discloses an emergency exit lock of this type.

More recently, a panic device has been developed with a relatively large panel actuator mounted at mid-level on the inside face of the door in place of the more conventional U-bar actuator and one such panic device is disclosed in U.S. Pat. No. 4,225,163.

U.S. Pat. No. 3,888,046 discloses an entrance having a pair of doors with a rectractable astragal on one door operatively interconnected with a panic actuator so as to retract the astragal from interfering with the adjacent door when the panic device is actuated, thus permitting the door to swing open for emergency exit.

U.S. Pat. No. 4,204,369 discloses an entrance system having an automatic astragal and panic device on one door and the astragal is interconnected to actuate upper and lower latches engageable with the sill and head of the fixed door frame.

U.S. Pat. No. 4,283,882 discloses a safety flush bolt entrance door sytem having a latch engageable between a pair of doors to lock the doors together in a closed position.

It is an object of the present invention to provide a new and improved entrance for buildings having a need for a panic device providing emergency exit capability and more particularly, an entrance of the type described having a latch for interconnecting the doors for preventing displacement of the stiles to avoid permitting access to the panic device by an implement inserted from the outside between the stiles.

It is another object of the present invention to provide an entrance system for public, industrial and commercial buildings and the like equipped with panic devices for emergency opening of the entrance doors wherein the doors in a common frame are latched with a security latch, extended between adjacent door stiles for preventing unauthorized displacement or deformation of the door stiles with burglar tools and the like.

Still another object of the present invention is to provide a new and improved entrance for buildings the character described wherein first and second doors are mounted in a common frame with a panic device on at least one of the doors and a retractable latch extendable between adjacent stiles of the doors and operatively interconnected with the panic device for retraction of the latch when the panic device is actuated to open a door.

BRIEF SUMMARY OF THE INVENTION

The foregoing and other objects and advantages of the present invention are accomplished in a new and improved entrance for buildings and the like comprising first and second doors mounted in a common fixed door frame. Each door includes a lock stile and the lock stiles of the doors are positioned closely adjacent one another when the doors are closed. At least one of the doors is provided with a panic device for emergency opening of the door from inside the building and a retractable latch is extendable between the adjacent stiles of the doors when closed for minimizing the possibility of an unauthorized forced separation or displacement of the stiles so as to afford a thief unauthorized access to the panic device from outside of the building. Mechanism is provided for operatively interconnecting the latch with the panic device for retraction of the latch when the panic device is actuated for opening the door.

BRIEF DESCRIPTION OF THE DRAWINGS

For a better understanding of the present invention, reference should be had to the following detailed description taken in conjunction with the drawings, in which:

FIG. 1 is an outside elevational view of a new and improved entrance system for buildings and the like;

FIG. 2 is a horizontal cross-sectional view taken substantially along lines 2—2 of FIG. 1;

FIG. 3 is a horizontal cross-sectional view similar to FIG. 2, illustrating in animated fashion an entrance wherein adjacent door stiles have been forcefully separated or displaced, thus permitting unauthorized access from outside the building with an implement engageable to actuate the panic device on the inside.

BRIEF DESCRIPTION OF PREFERRED EMBODIMENTS

Figure 4:
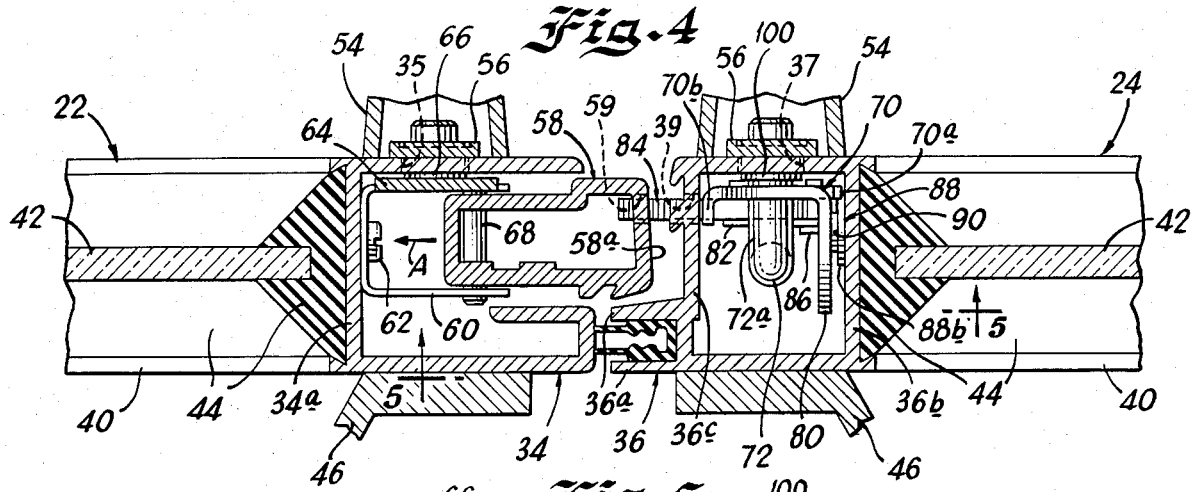
FIG. 4 is a fragmentary, horizontal cross-sectional view taken substantially along lines 4—4 of FIG. 1.

Referring now more particularly to the drawings, in FIG. 1 is illustrated a new and improved entrance 20 designed and especially adapted for use in public, commercial and industrial buildings and the like. The entrance includes a left-hand door 22 and a right-hand door 24 mounted in a common fixed door frame. The fixed door frame comprises a pair of vertical jambs 26 interconnected at the upper ends by a header 28 and at the lower ends by a sill 30 along the floor of the building.

Figure 6:
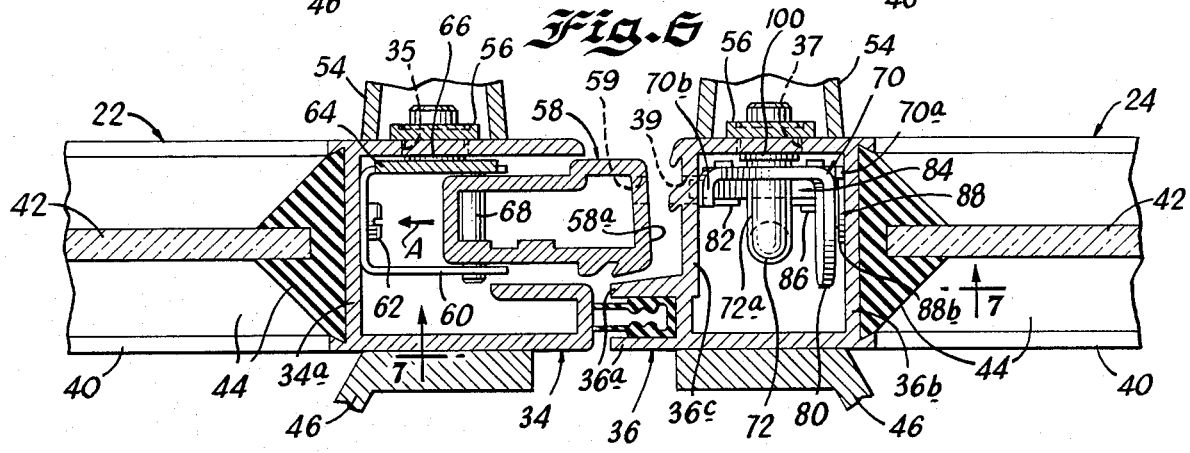
FIG. 6 is a fragmentary horizontal cross-sectional view similar to FIG. 4 but, illustrating a latch in accordance with the present invention in a retracted position.

Each door includes a rectangular frame work, preferably formed of hollow tubular extruded aluminum members and comprising a vertical hinge stile 32 attached to the adjacent jamb 26 with hinges for supporting the door for outwardly swinging movement between an open position and a closed position as shown in FIGS. 2, 4 and 6. The left-hand door 22 includes a vertical lock stile 34 parallel of the hinge stile 32 and the vertical stiles of the door 22 are interconnected adjacent the upper and lower ends by an upper rail 38 and a lower rail 40. The righthand door 24 includes a vertical lock stile 36 which is adapted to closely face and parallel the lock stile 34 of the left-hand door when when the doors are closed as illustrated. The vertical stiles 32 and 36 of the right-hand door 24 are also interconnected by an upper rail 38 and a lower rail 40 similar to the rails of the door 22.

Each door frame defines a large rectangular opening in which a panel 42 of glass, metal or other material is mounted and glazing strips 44 are provided around the periphery of the panels to secure and support the edges of the panels in place within the door frames. On the outside face, each door is provided with a handle 46 at a convenient height or level above the sill 30 for opening and closing the door from the outside to provide convenient ingress into the building from the outside.

On the interior face, each door is provided with a panic actuating device 48 including a horizontal panic bar 50 supported at opposite ends by a pair of arms 52 forming a U-bar type panic actuator. The arms extend inwardly toward the inside door face and are supported on horizontal pivot pins generally parallel of the panic bar 50 and mounted on brackets or housings 54 secured to the inside wall faces of the vertical door stiles.

U.S. Pat. No. 2,910,857 discloses internal details of the housings 54 and the pivot pins that are used for supporting the arms of the U-bar and reference should be had to the disclosure of this patent and to U.S. Pat. No. 3,888,046. As illustrated in these patents, the mounting pins supporting the arms 52 of the panic bar are aligned on a common horizontal axis and inner end portions of the arms are adapted to engage and move vertical slide elements 56 which are mounted on the inside wall faces of the respective vertical door stiles 34 and 36. When the panic device actuator 48 is activated by pressure on the panic bar 50 in a direction toward the door face, the arms 52 are pivoted to elevate or lift the slides 56 and this action unlocks or unlatches the door to swing outwardly open and permit emergency egress from the interior of the building.

When the exterior slide 56 on the left-hand door 22 is lifted by activation of the panic device 48, an elongated astragal 58 mounted in the door stile 34 is retracted inwardly (arrows A in FIGS. 4 and 6) into a retracted position wherein an outer wall 58*a* is clear of a pair of outwardly projecting walls 36*a* on the right-hand door stile 36. With the astragal 58 retracted, the left-hand door 22 may then swing freely outwardly without interference with the door 24 in order to provide emergency egress from the building.

As set forth in greater detail in U.S. Pat. No. 3,888,046, the astragal 58 is supported in a channel-like astragal housing 60 mounted on a transverse web or inner wall 34*a* of the lock stile 34 and secured thereto with cap screws 62 at appropriate intervals. The exterior slide 56 which is mounted on the interior wall face on the lock stile 34 is interconnected by means of pins 66 with an interior slide element 64 mounted for vertical sliding movement within the stile. The pins 66 extend through vertical slots 35 in the inside wall face of the lock stile 34 and the inner ends of the pins are connected to the interior slide 64. The slide 64 is interconnected with the astragal 58 by means of an activator pin 68 which projects through sloping slots provided in opposite sidewalls of the astragal to retract the astragal inwardly as more fully detailed in U.S. Pat. Nos. 3,888,046 and/or 4,204,369. As described in U.S. Pat. No. 4,204,369, the astragal 58 may be interconnected with retractable latching mechanisms 78 and 74 mounted adjacent the upper and lower ends of the lock stile 34. Such astragal activated latch mechanisms may be utilized when required or needed to provide additional security against unauthorized opening of the doors.

In accordance with the present invention, the panic actuating device 48 on the right-hand door 24 is effective to elevate the exterior slide 56 mounted on the lock stile 36 in a manner similar to that previously described for the left-hand door 22. The exterior slide 56 is interconnected with an interior slide element 70 (best shown in FIG. 12) by means of an outwardly extending, short upper end portion 72*a* of a lower connector rod 72. The rod extends longitudinally down the hollow interior of the lock stile 36, and at the lower end is interconnected to a lower latch element 74 mounted in the stile and adapted to provide releasable latching engagement between the lower corner of the door 24 and the sill 30 of the fixed door frame. The short upper end portion 72*a* of the rod 72 projects through a vertical slot 37 formed in the inside wall of the lock stile 36 and a similar slot, aligned and spaced vertically upwardly of the lower slot 37 is provided in order to accommodate a short, outwardly extending lower end portion 76*a* of an upper control rod 76. The upper rod 76 extends longitudinally upwardly from an upper end portion of the exterior slide 56 and is operatively interconnected at the upper end to an upper latch 78. The upper latch is releasably engageable with the header 28 of the fixed door frame and normally latchs the upper corner of the door 24 to the fixed frame.

The upper and lower control rods 76 and 72 and their respective latches 78 and 74 are described in detail in the aforementioned U.S. Pat. No. 3,888,046 and reference should be had to this patent for a more complete description of the latches and the operation thereof. Upper and lower latches of the type shown in U.S. Pat. No. 4,283,882 may also be used in conjunction with the upper and lower control rods 76 and 72 and/or the astragal 58.

When the panic device 48 on the right-hand door 24 is activated by inward pressure on the panic bar 50, the inner ends of the panic arms 52 are elevated causing the exterior slide 56 to move upwardly along the inside face of the lock stile 36. When this occurs, the upper and lower control rods 76 and 72 are moved upwardly to retract the latches of the upper and lower latching mechanisms 78 and 74 and the right-hand door 24 may then be opened to swing outwardly and permit emergency egress from the interior of the building. The right-hand door 24 is a normally active door during regular business hours of use of the entrance system 20.

and the panic device 48 may be retained and secured in an activated position to retract and maintain the upper and lower latches in a retracted position so that the door will open and close freely for normal building traffic.

Figures 11, 12:
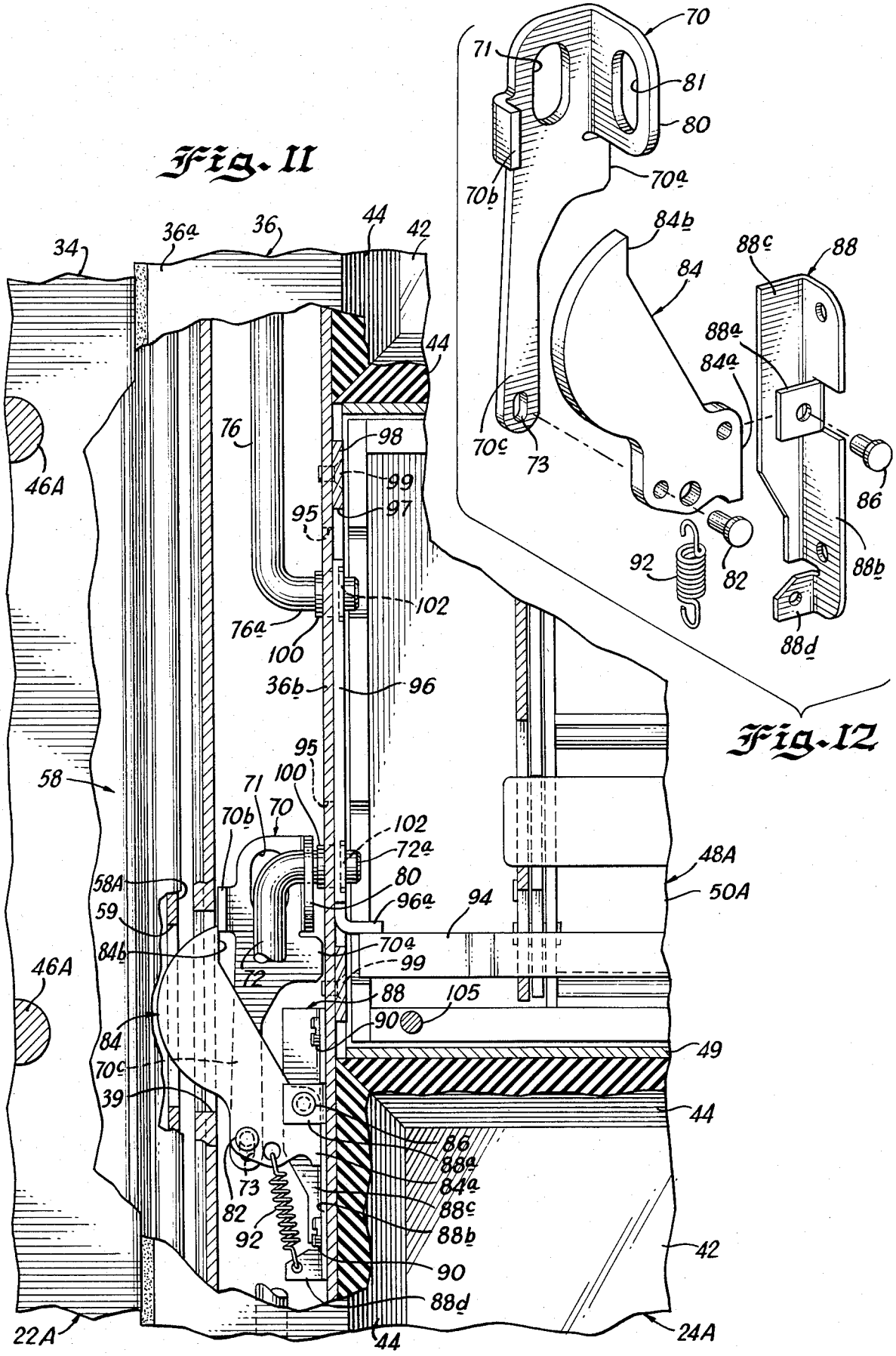
FIG. 11 is a fragmentary, vertical, cross-sectional view taken substantially along lines 11—11 of FIG. 9.
FIG. 12 is an exploded perspective view of a latch and slide mechanism for actuating the latch in accordance with the features of the present invention.

Referring now particularly to FIG. 12, the interior slide 70 is provided with a right angle wing portion 80 at the upper end of the main body of the slide and the wing is positioned to closely face and parallel a transverse wall 36*b* of the lock stile 36. The main body of the slide 70 is formed with a vertical slot 71 adjacent the upper end to accommodate the short horizontal segment 72*a* of the lower latch rod 72. The rod extends through a bushing 100 mounted in the slot 71 as shown and the rod is effective to raise and lower the interior slide 70 in response to vertical movement of the exterior slide 56 on the inside face of the door. A similar slot 81 is formed in the wing 80 for a purpose to be described hereinafter when a different type of panic actuating device is utilized.

The upper end portion of the interior slide 70 is guided for general vertical movement within the hollow interior of the lock stile 36 between the inside transverse wall 36*b* and an outside wall 36*c* by a guide lug 70*a* on the main body of the slide below the wing 80 and a small stop lug 70*b* which is transverse to the body. The interior slide includes a narrow, depending lower end portion or tail 70*c* having a small vertically extending slot 73 adjacent the lower end. The slot 73 accommodates a headed pivot pin 82 for pivotally interconnecting the tail of the slide with a latch 84.

The latch 84 is mounted on a headed pin 86 for pivotal movement between an outward latching position (FIGS. 4 and 5) wherein an outer portion thereof extends into an elongated vertical slot 59 in the astragal 58 and a retracted position (FIGS. 6 and 7) wherein the latch is fully contained within the stile 36. The outer transverse wall 36*c* of the stile is formed with a narrow vertical slot 39 for accommodating the latch 84 and the slot 39 is positioned to directly face and parallel a slot 59 in the astragal 58 when the doors 22 and 24 are in the closed position. The outer wall 58*a* of the astragal serves as a strike plate for the latch 84. The pivot pin 86 is secured to a tang 88*a* on a sheet metal bracket 88 having a base 88*b* secured to the wall 36*b* by a pair of cap screws 90. The bracket also includes an outwardly extending flange 88*c* parallel of the tang 88*a* and the lower end portion of the latch 84 is guided in sandwiched fashion between this flange and the tang.

The pivotal latch 84 is biased toward a latched or engaged position by a coil spring 92 having an upper end connected to an aperture in the latch eccentric of the pivot axis of the pin 86. A lower end of the spring is connected to a small tang 88*d* at the lower end of the sheet metal bracket 88. Outward pivotal movement of the latch toward the latched position as shown in FIG. 5 is limited by engagement of a stop surface 84*a* extending below the pivot pin and engage against the base 88*b* of the bracket.

Figure 5:
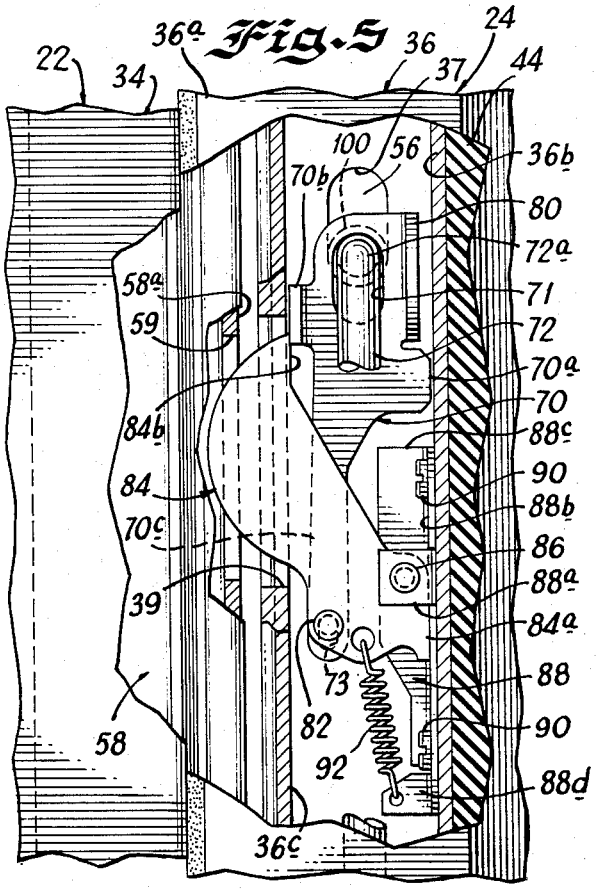
FIG. 5 is a vertical cross-sectional view taken substantially along lines 5—5 of FIG. 4.
Figure 7:
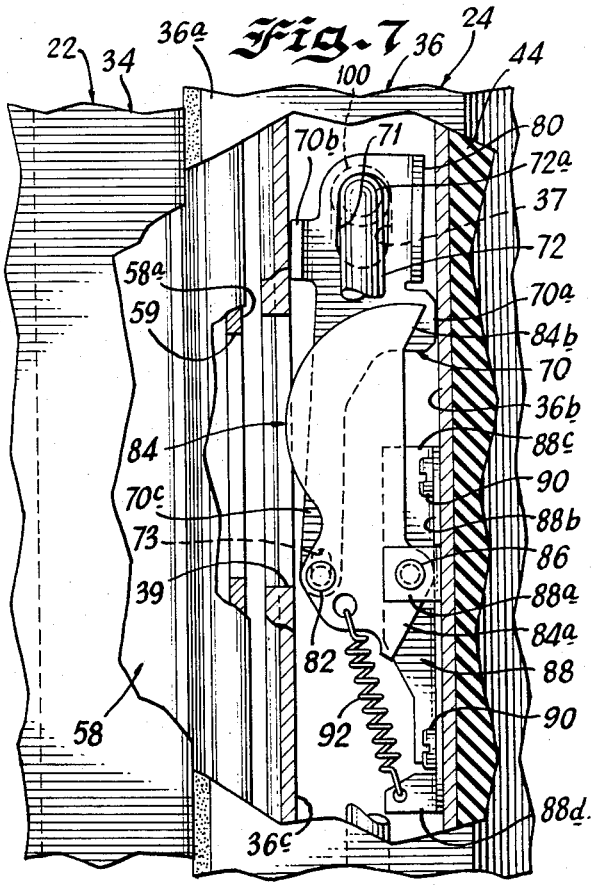
FIG. 7 is a vertical cross-sectional view taken substantially along lines 7—7 of FIG. 6.
Figure 8:
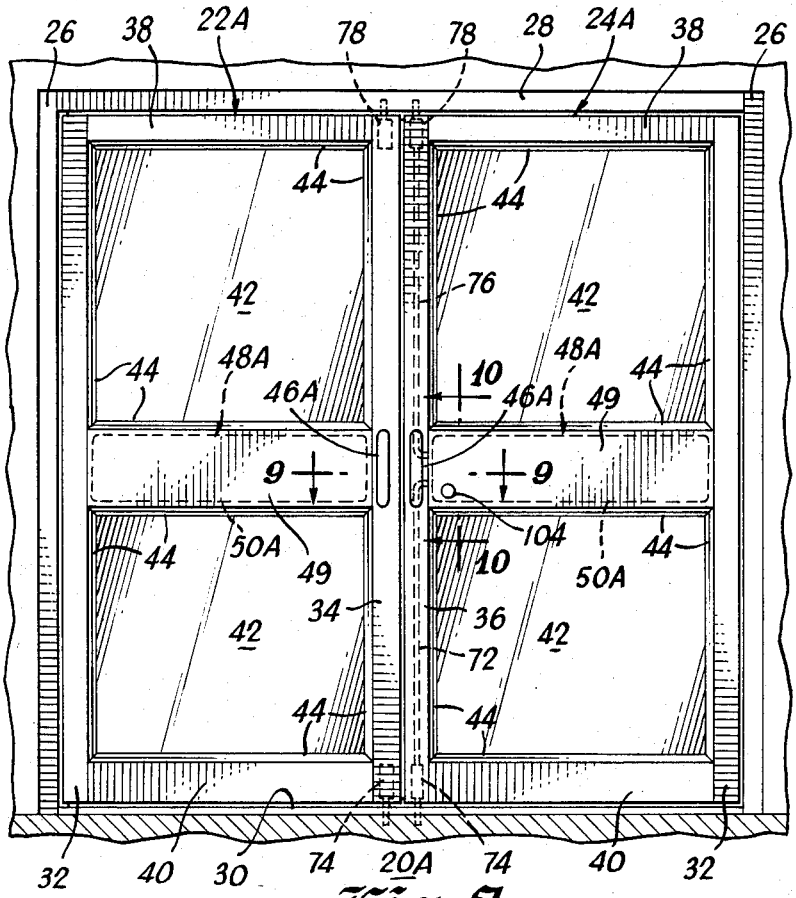
FIG. 8 is an inside elevational view of another embodiment of an entrance system in accordance with the features of the present invention.

In accordance with the present invention, an upper end or tip portion of the pivotal latch 84 is formed with a flat stop surface 84*b* normally engageable against the stop lug 70*b* on the slide 70 when the latch is in an extended or latched condition as shown in FIGS. 4 and 5. The stop lug 70*b* positively prevents inward movement of the pivotal latch 84 by unauthorized means such as a screw driver or other implement forcibly inserted into the space between the stiles 34 and 36 and the astragal wall 58*a*. Thus it is difficult or impossible for a thief or unauthorized person to gain entry by physically deflecting or pivoting the latch 84 out of the latched position as shown in FIGS. 4 and 5 to an unlatched condition as shown in FIGS. 6 and 7 by the insertion of a wire, tool or other implement from outside the building.

Latched engagement between the latch member 84 and the astragal 58 interlocks the facing door stiles 34 and 36 of the respective left and right hand doors 22 and 24 in the closed position so that it is difficult or impossible for a thief or unauthorized person to forcefully separate or deflect the stiles apart as shown in FIG. 3. Also, when the stiles are latched together with the latch 84 as shown, it is difficult or impossible to insert a coathanger, wire or other implement into the space between the stiles and spread the stiles apart for the purpose of operating the panic devices on the inner faces of the doors to gain unauthorized entrance.

As described, the right hand door 24 is latched to the fixed door frame with the latch mechanisms 74 and 78 and the pivoting latch 84 is provided to positively latch the lock stile 36 of the right hand door 24 to the astragal 58 on the lock stile 34 of the adjacent left hand door 24. When the left hand door 22 and the right hand door 24 are interlocked as described, the result is a secure entrance system which still affords a panic exit capability on both of the doors in the event of an emergency. In addition, enhanced security may be provided by upper and lower latches 78 and 74 on the door 22 interconnected to be operated by the astragal 58 as set forth in greater detail in U.S. Pat. No. 4,204,369 and/or U.S. Pat. No. 3,888,046.

Referring now to FIGS. 8–11 therein is illustrated another embodiment of an entrance referred to by the reference numeral 20A which is generally similar to the entrance previously described but which includes a pair of doors 22A and 24A which are provided with panic devices 48A. These panic devices employ enlarged panels 50A supported from an intermediate door rail 49 extending between the lock and hinge stiles of each door. The panel actuated panic devices 48A are described in detail in U.S. Pat. No. 4,225,163 and reference should be had to this patent for a more complete and better understanding of the working operation thereof.

Figure 10:
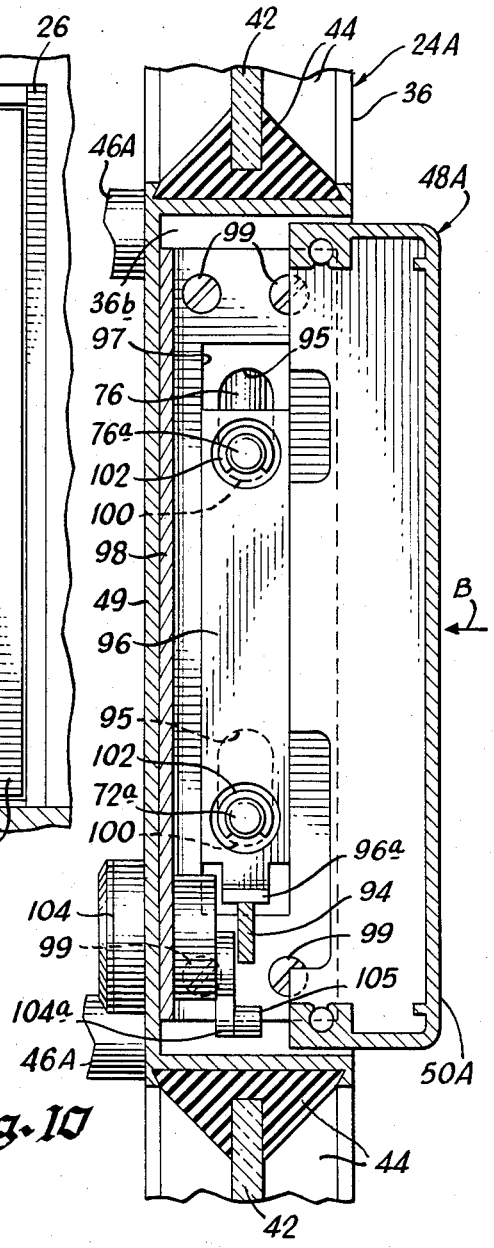
FIG. 10 is a fragmentary, vertical cross-sectional view taken substantially along lines 10—10 of FIG. 8.
Figure 9:
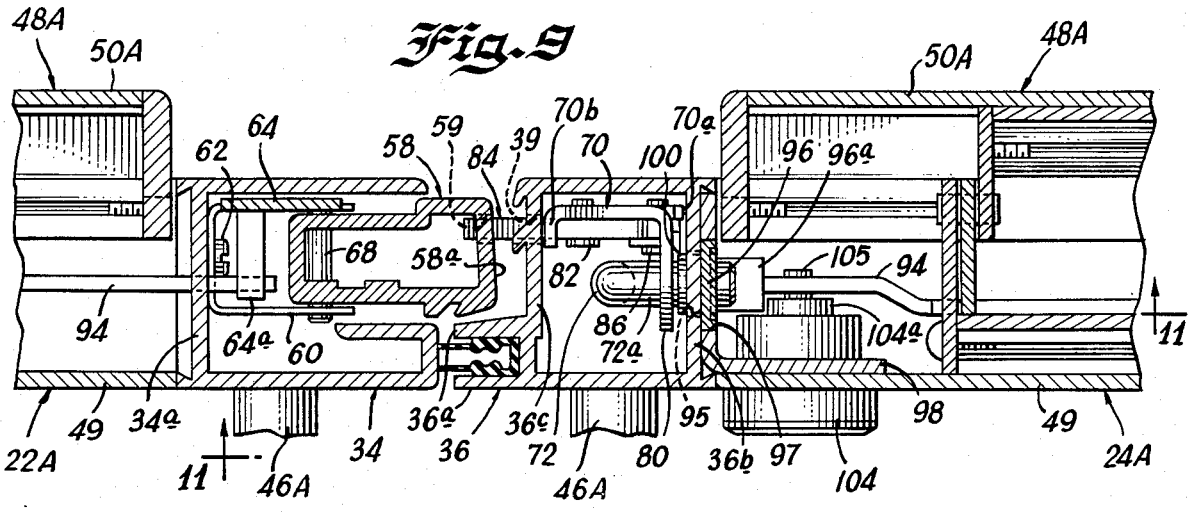
FIG. 9 is a fragmentary, horizontal, cross-sectional view taken substantially along lines 9—9 of FIG. 8.

Inward pressure on the panels 50A as indicated by the arrow B in FIG. 10 is effective to elevate a lever 94 having free outer end portion engageable with a tab 96*a* of a slide element 96 mounted for sliding movement in a vertical slot or guideway 97 defined in an angle bracket 98. The bracket is secured to the outside face of the wall 36*b* of the door stile 36. Cap screws 99 are provided to secure a base flange of the bracket 98 to the outside surface of the wall 36*b*. The wall is formed with a pair of slots 95 as best shown in FIGS. 10 and 11 in order to accommodate the short end portions 72*a* and 76*a* of lower and upper latch control rods 72 and 76 respectively. The exterior slide 96 is provided with a pair of vertically spaced apertures and the rod end portions extend through bushings 100 mounted in these apertures. The rods are secured in place with "C" rings 102. Accordingly, when the panic actuating panel 50A is depressed inwardly as indicated by the arrow B, the outer free end of the lever 94 moves upwardly and elevates the slide 96 which carries the control rods 72 and 76 upwardly to release the latches 74 and 78. When the latches are released at the lower and upper ends of the stile 36, the door 24A may swing open freely to provide emergency egress. At the same time the latch mechanisms are releasing, the short upper end portion 72a of the lower control rod 72 causes the slide 70 to move upwardly and pivotally release the latch 84 from the latched or extended condition of FIG. 11 into a retracted position within the stile.

The slide 70 is universal and may be utilized with either a U-bar type panic device 48 or a panel actuated panic device 48A without any changes being required. The short upper end segment 72a of the lower control rod 72 is adapted to extend through the slot 81 in the wing 80 of the slide to elevate the same whenever the lever 94 is moved upwardly from the position shown in FIGS. 10 and 11 by activation of the panel 50A.

In the lefthand door 22A a similar lift lever 94 is provided for elevating the internal slide 64 whenever the panel 50A is pressed inwardly in order to retract the astragal 58 and permit the door 22A to swing open. The lever 94 is engaged with a lug 64a on the interior slide. The door 24B is normally an active door during normal business hours and is provided with a key operated exterior lock 104 having an arm 104a with a lug 105 on the outer end adapted to elevate the outer end portion of the arm 94 to unlatch the door for opening. The U-bar type panic devices 48A may also be retained in an elevated position by a key operated lock so that the one or both doors 22 and 24 may swing freely open as active doors when desired.

It will thus be seen that the slide 70, latch 84 and supporting bracket and pins (FIG. 12) are capable of use with either a U-bar panic device 48 or a panel actuated device 48A without significant modification. The entrance 20A including the left hand door 22A and the righthand door 24A equipped with panel actuated panic devices 48A is effective to provide excellent security when closed and locked yet still provide for emergency egress from a building under an emergency situation. Similarly, the entrance 20 provides equivalent security with the U-bar panic devices 48 on the doors 22 and 24. In both embodiments, the stiles 34 and 36 of the respective doors are maintained in latched or locked together condition by the pivoting latch 84 normally engaging the slotted astragal 58.

Although the present invention has been described with reference to several illustrated embodiments thereof, it should be understood that numerous other modifications and embodiments can be made by those skilled in the art that will fall within the spirit and scope of the principles of this invention.

What is claimed as new and desired to be secured by Letters Patent is:

1. An entrance for buildings, comprising:

first and second doors mounted in a common frame, each door including a lock stile positioned adjacent a lock stile of the other door when said doors are closed;

a panic device for emergency opening of at least one door;

latch means for securing said one door in latched engagement with said frame;

a retractable latch extending between the stiles of said doors when closed for minimizing the possibility of unauthorized, forced separation of the stiles; and means operatively interconnecting said latch with said panic device for retraction of the latch when said panic device is actuated, and also operatively interconnecting said latch means with said panic device for unlatching said one door from said frame when said panic device is actuated, including slide means mounted in said lock stile of said one door for reciprocal movement longitudinally thereof between latch extending and latch retracting positions of said latch means and having a first leg substantially parallel to a door face of said one door and a second leg substantially normal thereto.

2. The entrance of claim 1, wherein:

said panic device on said one door includes an operator engaging said first leg of said slide means for moving the same between said latch extending and latch retracting positions.

3. The entrance of claim 1, wherein:

said panic device on said one door includes an operator engaging said second leg of said slide means for moving the same between said latch extending and latch retracting positions.

4. The entrance of claim 1, wherein:

said means operatively interconnecting said latch with said panic device includes stop means for preventing retraction of said latch until said panic device is actuated.

5. The entrance of claim 4, wherein:

said latch is biased toward an extended position engaged between said lock stiles of said doors in closed position.

6. The entrance of claim 4, wherein said stop means comprises said second leg.

7. An entrance for buildings, comprising:

first and second doors mounted in a common frame, each door including a lock stile positioned adjacent a lock stile of the other door when said doors are closed;

first and second panic devices for emergency opening of said first and second doors, respectively;

an astragal mounted on the lock stile of said second door, being movable between an extended position adapted for engaging said first door to preclude opening of said second door when said first door is closed and a retracted position permitting said second door to be opened while said first door is closed;

a retractable latch extending between the stiles of said doors, when closed, and engaging said astragal, when extended, for minimizing the possibility of unauthorized, forced separation of the stiles; and means operatively interconnecting said latch with said first panic device for retraction of the latch when said first panic device is actuated for opening said first door.

8. The entrance of claim 7, wherein:

said astragal includes a surface with a slot therein forming a strike for receiving said latch when extended with said doors in a closed position.

9. The entrance of claim 7, wherein said means operatively interconnecting said latch with said first panic device includes stop means for preventing retraction of said latch until said first panic device is actuated.

10. The entrance of claim 7, including:

latch means for securing said first door in latched engagement with said frame; and said means operatively interconnecting said latch with said panic device including means interconnecting said panic device and said latch means to unlatch said first door from said frame upon actuation of said panic device.

11. The entrance of claim 10, wherein:

said means operatively interconnecting said latch means and said panic device includes slide means mounted for movement longitudinally of said lock stile of said first door.

12. The entrance of claim 11, wherein:

said slide means is mounted in said lock stile of said first door for reciprocal movement longitudinally thereof between latch extending and latch retracting positions.

13. The entrance of claim 12, wherein:

said slide means includes a first leg parallel of a door face of said first door and a second leg normal thereto.

* * * * *